US006945618B2

(12) United States Patent
Kim et al.

(10) Patent No.: US 6,945,618 B2
(45) Date of Patent: Sep. 20, 2005

(54) DRAWER SLIDE ADJUSTMENT MECHANISM

(75) Inventors: Daniel Kim, Santa Fe Springs, CA (US); Baoloc Le, La Puente, CA (US)

(73) Assignee: Accuride International Inc., Santa Fe Springs, CA (US)

( * ) Notice: Subject to any disclaimer, the term of this patent is extended or adjusted under 35 U.S.C. 154(b) by 0 days.

(21) Appl. No.: 10/453,842

(22) Filed: Jun. 2, 2003

(65) Prior Publication Data

US 2004/0239219 A1 Dec. 2, 2004

(51) Int. Cl.[7] ..... A47B 88/00
(52) U.S. Cl. ..... 312/334.4; 312/334.5
(58) Field of Search ..... 312/333, 330.1, 312/334.4, 334.5, 334.6, 334.27, 334.1, 334.14, 334.24, 334.29, 334.3, 334.31, 334.32, 334.34, 334.33, 350; 384/22; 403/331, 252, 256

(56) References Cited

U.S. PATENT DOCUMENTS

| | | | | | |
|---|---|---|---|---|---|
| 2,698,214 | A | | 12/1954 | Skamser | |
| 2,928,696 | A | | 3/1960 | Hiers | |
| 4,021,129 | A | * | 5/1977 | Sykes | 403/252 |
| 4,642,846 | A | * | 2/1987 | Lautenschlager | 16/382 |
| 4,810,045 | A | * | 3/1989 | Lautenschlager | 312/334.5 |
| 4,842,422 | A | * | 6/1989 | Nelson | 384/19 |
| 5,257,861 | A | | 11/1993 | Domenig et al. | |
| 5,375,922 | A | | 12/1994 | Brüstle et al. | |
| 5,439,283 | A | * | 8/1995 | Schroder et al. | 312/334.4 |
| 5,556,182 | A | | 9/1996 | Lai | |
| 5,588,729 | A | * | 12/1996 | Berger | 312/334.4 |
| 5,664,855 | A | | 9/1997 | Lautenschläger et al. | |
| 5,842,759 | A | | 12/1998 | Ferrari et al. | |
| 6,447,083 | B1 | * | 9/2002 | Chiapetta et al. | 312/404 |
| 6,481,812 | B1 | * | 11/2002 | Domenig et al. | 312/334.6 |
| 6,585,336 | B2 | | 7/2003 | Munday et al. | |
| D488,712 | S | | 4/2004 | Kim | |
| 2002/0190618 | A1 | | 12/2002 | Salice | |
| 2004/0145286 | A1 | * | 7/2004 | Kim | 312/334.4 |

FOREIGN PATENT DOCUMENTS

| | | | | |
|---|---|---|---|---|
| DE | 2462538 | * | 8/1977 | 312/334.4 |
| EP | 1093735 | * | 8/2000 | |
| GB | 1582894 | * | 1/1981 | 312/334.4 |

OTHER PUBLICATIONS

International Search Report dated Oct. 20, 2004 for International Patent Application No. PCT/US2004/017543, filed Jun. 2, 2004, International Search Report mailed Dec. 8, 2004 (2 pgs.).

Written Opinion of the International Searching Authority for International Patent Application No. PCT/US2004/017543, filed Jun. 2, 2004, Written Opinion of the International Searching Authority mailed Dec. 8, 2004 (3 pgs.).

Accuride data sheet for "Accu–Flach Typ 7520" Belastung bis 250N, 484–1–0292, Part No. 26003300 (1 page double sided), date unknown.

* cited by examiner

*Primary Examiner*—Janet M. Wilkens
(74) *Attorney, Agent, or Firm*—Christie, Parker & Hale LLP

(57) ABSTRACT

A drawer slide positioning mechanism providing two directional adjustment of a drawer with respect to a drawer slide. The positioning mechanism fits within an outline of a rail of a drawer slide. The positioning mechanism includes a vertical adjustment element and a horizontal adjustment element.

14 Claims, 5 Drawing Sheets

DRAWER SLIDE ADJUSTMENT MECHANISM

BACKGROUND OF THE INVENTION

The present invention relates generally to drawer slide adjustment mechanisms, and more particularly to a vertical and horizontal drawer slide adjustment mechanism.

Drawer slides are ubiquitous in extendably coupling cabinets with drawers, shelves, and the like. The drawer slides allow a drawer, for example, to be extended from a cabinet to provide easy access to the contents of the drawer. Drawer slides are also used in a number of other applications, including rack-mounted applications or whenever mounting of an item in an extendible manner is desired.

Drawer slides often have a first rail coupled to a cabinet and a second rail coupled to a drawer. The second rail generally is extendable from the first rail. In addition, some drawer slides may have an intermediate rail coupling the first rail and the second rail, forming a three rail drawer slide.

At times, proper installation of drawer slides may be difficult. With a drawer fixedly attached to a drawer slide, and the drawer slide fixedly attached to a cabinet, misalignment of the drawer slide may result in the drawer being misaligned with the cabinet. In addition, tolerance of the cabinet and drawer may require adjustments, on a drawer by drawer basis, to achieve proper fit of the drawer within the cabinet, preferably without binding or gaps.

SUMMARY OF THE INVENTION

One aspect of the invention provides a drawer slide positioning mechanism comprising a mounting bar adapted to be mounted to a drawer; a tab coupled to the mounting bar; a first positioning element extending from the tab; and a second positioning element extending from the tab.

Another aspect of the invention provides a drawer slide and positioning element, comprising a drawer slide including a cabinet rail extensibly coupled to a shelf rail, the cabinet rail adapted to be coupled to a cabinet and the shelf rail adapted to be coupled to a drawer; a position adjustment mechanism coupled to the shelf rail, the position adjustment mechanism including means for adjusting the position of the shelf rail with respect to the drawer in a first direction and means for adjusting the position of the shelf rail with respect to the drawer in a second direction, the second direction being perpendicular to the first direction.

Another aspect of the invention provides a drawer slide and positioning element, comprising a drawer slide including a cabinet rail extensibly coupled to a shelf rail, the cabinet rail adapted to be coupled to a cabinet and the shelf rail adapted to be coupled to a drawer; a position adjustment mechanism coupled to the shelf rail, the position adjustment mechanism including a coupling bar and a tab extending from the coupling bar, the tab coupled to the shelf rail, with a threaded bolt passing through a threaded hole in the tab and a circular plate with an offset cylinder in a cutout of the tab.

These and other aspects of the invention are more fully comprehended with review of the figures and disclosure herein.

DETAILED DESCRIPTION

Figure 1:
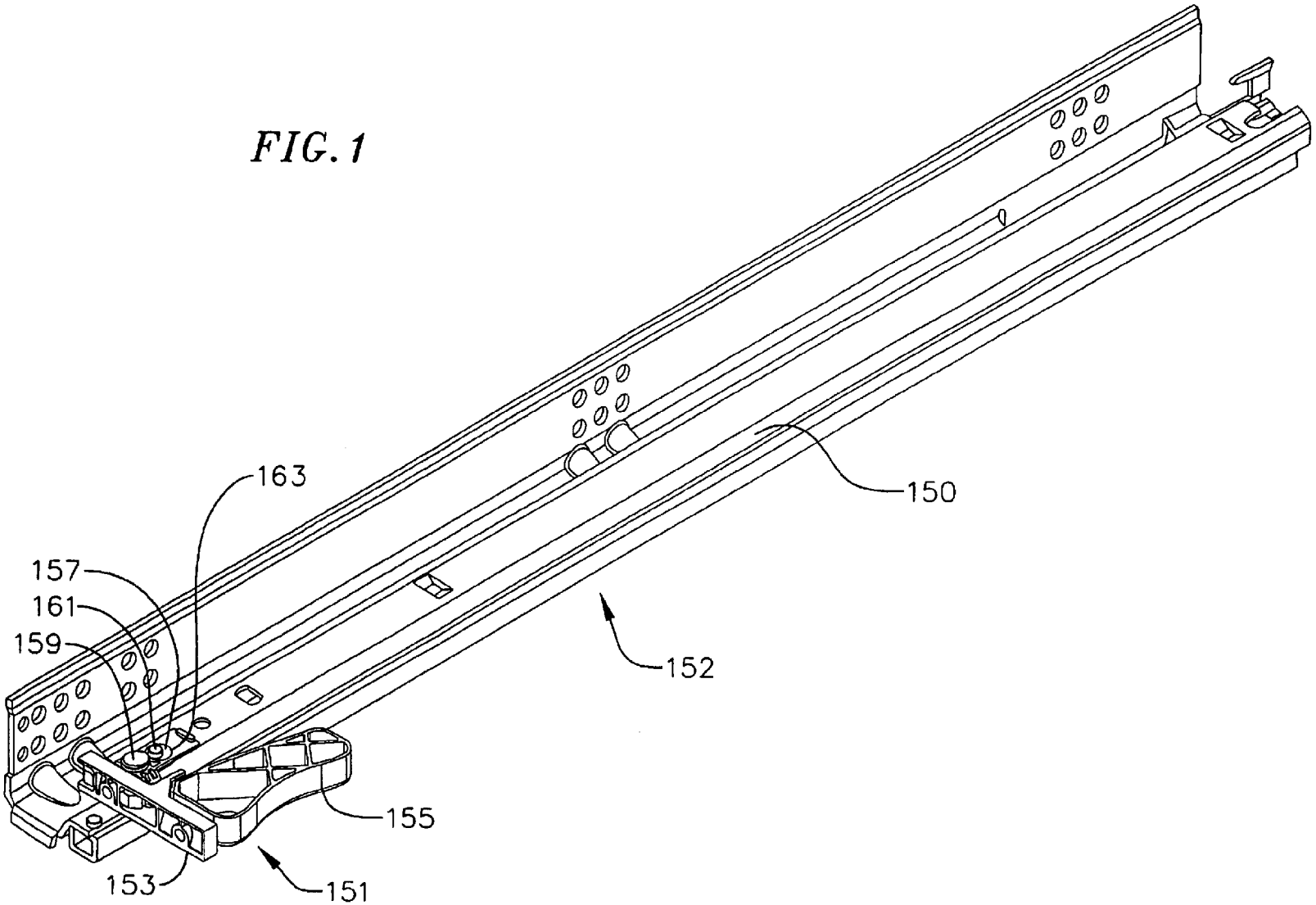
FIG. 1 illustrates a perspective view of an undermount drawer slide with a position adjustment mechanism in accordance with aspects of the invention.

FIG. 1 illustrates an undermount drawer slide 152 and position adjustment mechanism 151. The undermount drawer slide is generally positioned underneath a drawer (not shown). The position adjustment mechanism is placed at a front of a shelf rail 150, and includes a mounting bar 153 with a handle 155 and a positioning element 157. The positioning element is inserted within the outline formed by the shelf rail, with the handle extending parallel to the shelf rail. The mounting bar is coupled to a backside of a front of the drawer.

The positioning element includes a vertical positioning element 159 and a horizontal positioning 161 element, each extending through a cutout 163 of a web of the shelf rail. The vertical positioning element is movable, or translatable vertically within the cutout, it being understood that vertical and other directional terms being used with reference to a positioning element mounted with an undermount drawer slide. With the reference system so indicated with respect to FIG. 1, the horizontal positioning element includes a protrusion moveable from side to side, or horizontally, with respect to the undermount drawer slide.

With the mounting bar coupled to the drawer, adjustment of the vertical positioning element results in vertical displacement between the shelf rail and the drawer, and adjustment of the horizontal positioning element results in horizontal displacement between the shelf rail and the drawer.

Figure 2:
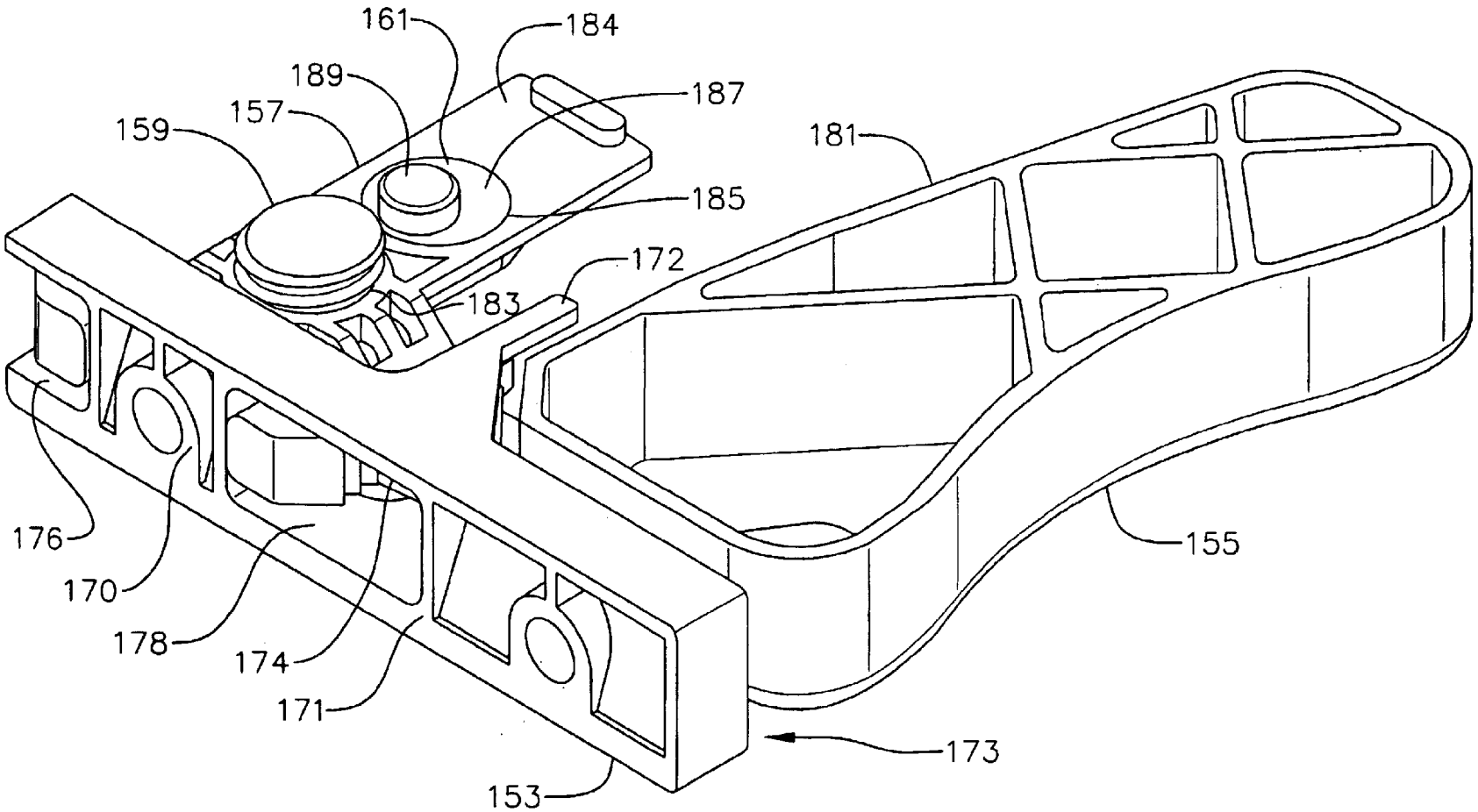
FIG. 2 illustrates a perspective view of a position adjustment mechanism in accordance with aspects of the invention.

FIG. 2 illustrates a perspective view of the positioning adjustment mechanism of FIG. 1, and includes the mounting bar 153 with handle 155 and the positioning element 157. The mounting bar forms a beam with a front surface 171 and a rear surface 173. The front surface is adapted to be placed against the back of a drawer front (not shown). The rear surface is adapted to receive the positioning element.

The positioning element is inserted about a post 170 of the mounting bar. An aperture 178 is located on one side of the post, the side adjacent the handle. A gap 176 in the mounting bar is on the other side of the post. On the positioning element, outward facing claws (shown as 203*a,b* in FIG. 3) are on either side of a recess (shown as 202 in FIG. 3). The recess is placed against the post of the mounting bar, with one of the claws in the gap and the other claw in the aperture. The gap and aperture have a height greater than that of the claws, allowing the claws to move up and down in the gap and aperture.

A tooth 174 extends into the aperture. The tooth extends from a hinge element 172 extending from the rear of the mounting bar. The hinge element normally biases the tooth into the aperture, and exerts a force on one of the claws so as to generally maintain the positioning element in position. The hinge element, of the embodiment of FIG. 2, is integrally formed with the mounting bar, and is of a type sometimes referred to as a living hinge.

The handle also extends from the hinge element of the mounting bar, on a side of the hinge element opposite the tooth. Rotation of the handle away from the living hinge results movement of the tooth away from the claw of the positioning element. If the handle is sufficiently rotated the tooth is pulled free from the claw.

The positioning element includes a tab 184. The vertical positioning element 159 and the horizontal positioning element 161 are in inset cutouts of the tab. When mated with a slide, as in FIG. 1, the tab is fixedly held in position with respect to the slide. The cutouts, as illustrated in FIG. 2, are circular in shape. The vertical positioning element is in the form of a threaded bolt. Rotation of the vertical positioning element translates the vertical positioning element with respect to the tab. The horizontal positioning element is in the form of a circular plate 187, with an offset cylinder 189 extending from the circular plate. The circular plate is positioned in one of the circular cutouts of the tab. Rotation of the circular plate results in relative movement of the offset cylinder with respect to the tab.

Referring again to FIG. 1, the vertical positioning element protrudes through the cutout in the shelf rail. In operation, rotation, and therefore vertical translation, of the vertical positioning element causes the vertical positioning element to press, or force, against the underside of a drawer sitting on the shelf rail. This force causes the claws to move within the gap and aperture, and thus causes movement in relative vertical position between the tab and mounting bar. With the mounting bar attached to the drawer and the tab fixed relative to the slide, the result is vertical movement, or positioning of the drawer, particularly the front of the drawer, relative to the slide.

The horizontal positioning element also protrudes through the cutout in the shelf rail, as illustrated in FIG. 1 the same cutout through which the vertical positioning element protrudes. The width of the portion of the cutout about the vertical positioning element, however, is only slightly larger than the diameter of the offset cylinder of the horizontal positioning element. Rotation of the horizontal positioning element results in horizontal translation of the offset cylinder. As the cutout is only slight larger than the offset cylinder, translation of the offset cylinder results in translation of the slide with respect to the position adjustment mechanism.

Figure 3:
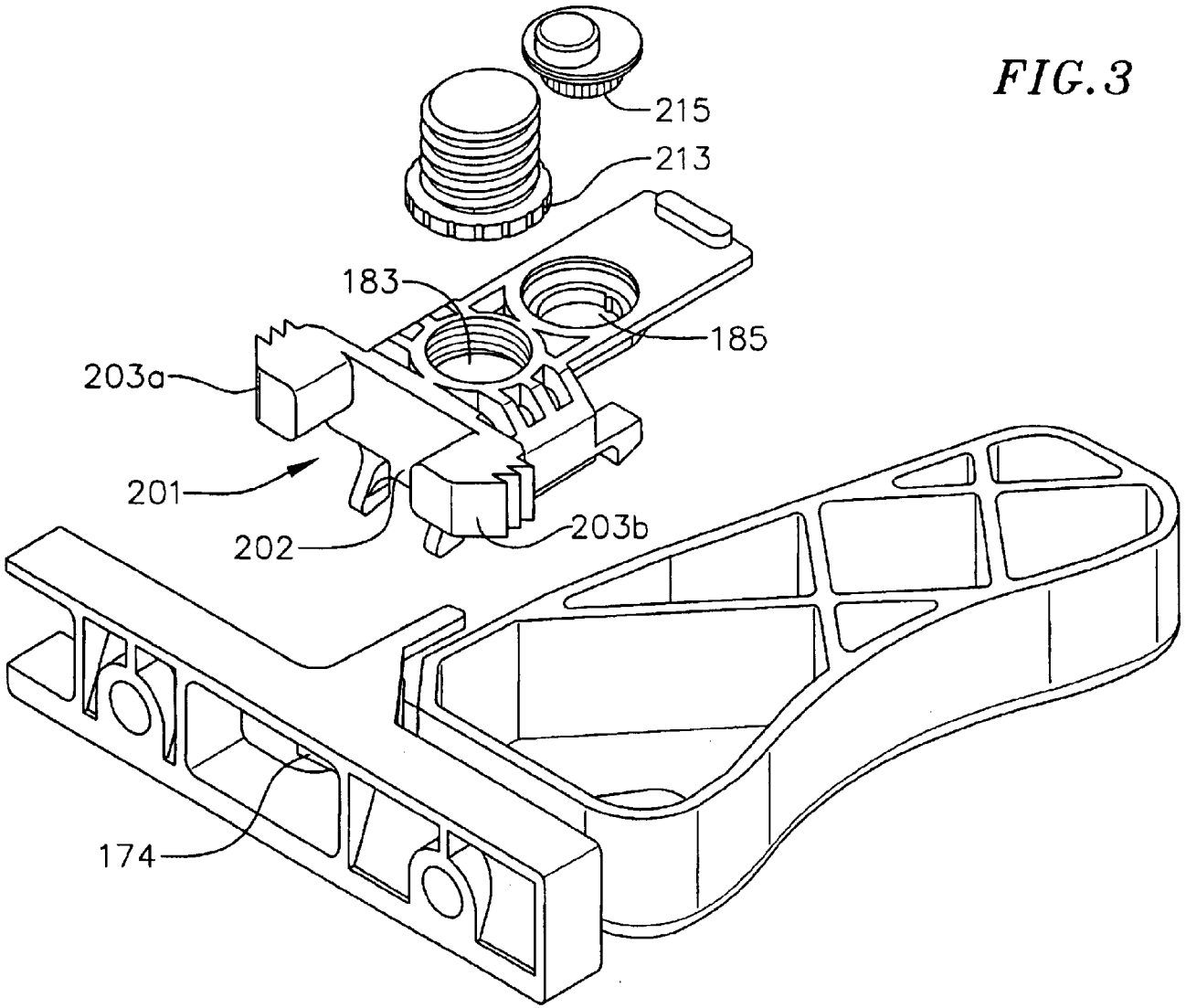
FIG. 3 illustrates a breakaway perspective view of portions of the position adjustment mechanism of FIG. 1.
Figure 4:
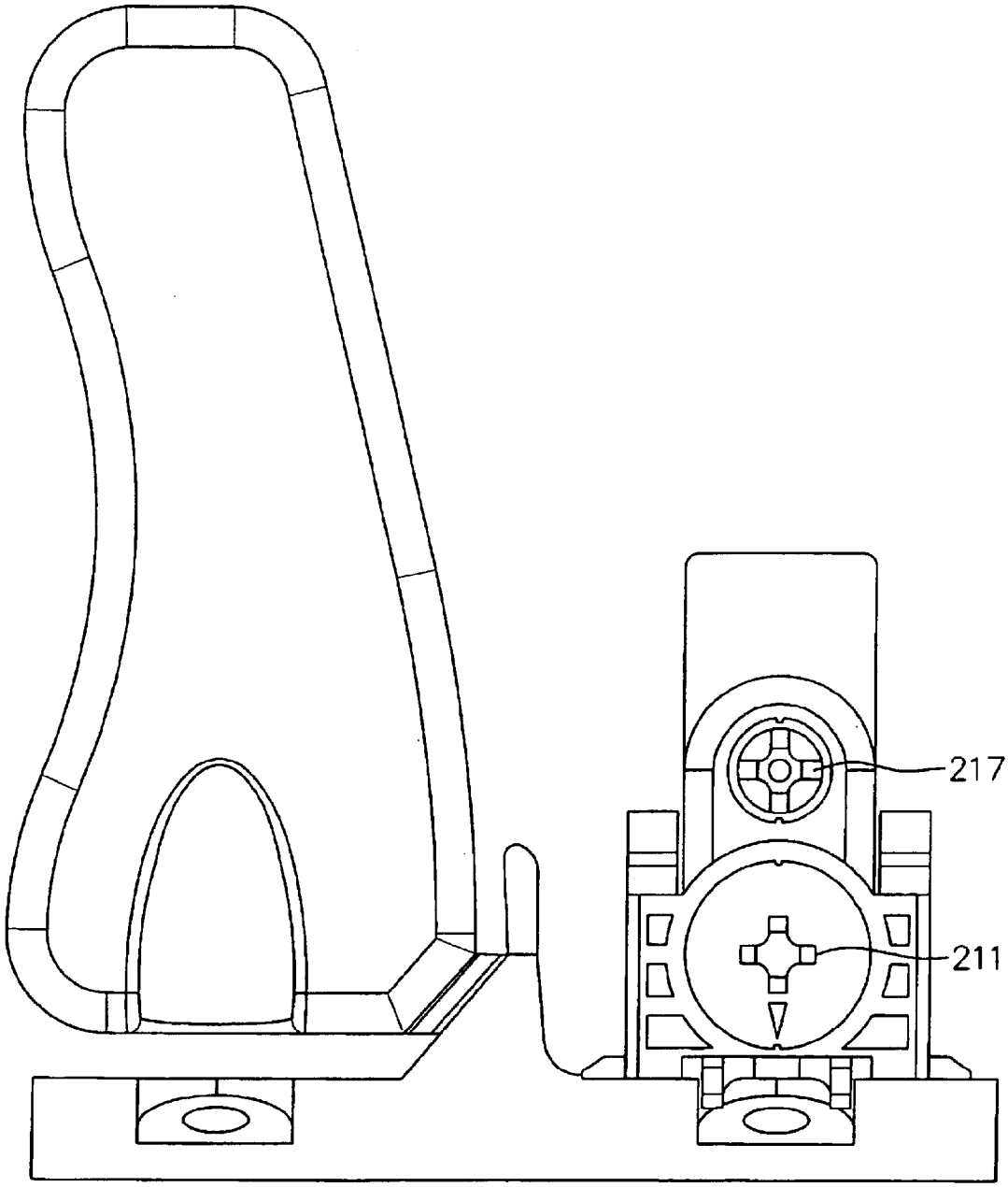
FIG. 4 illustrates a bottom view of the position adjustment mechanism of FIG. 1.

FIG. 3 illustrates a break away view of the mounting bar, tab, vertical positioning element and horizontal positioning element. The tab includes a mating end 201 with outward facing claws 203*a,b* adapted for insertion into the coupling bar. The tab also has threaded circular cutout 183 for receiving the vertical positioning element. The horizontal positioning element is adapted to be placed in a counter sunk hole 185 in the tab. The vertical positioning element is in the form of a threaded bolt, with a screw head (shown in FIG. 4 as 211) on a plate 213 forming a bolt head, with the plate of a larger diameter of the threaded portion of the vertical positioning element. The horizontal positioning element also has a plate 215 with a screw head (shown in FIG. 4 as 217). The plate with a screw head of the horizontal positioning element is smaller in diameter than the circular plate, so that the circular plate may support the horizontal positioning element within the countersunk hole of the tab.

Figure 5:
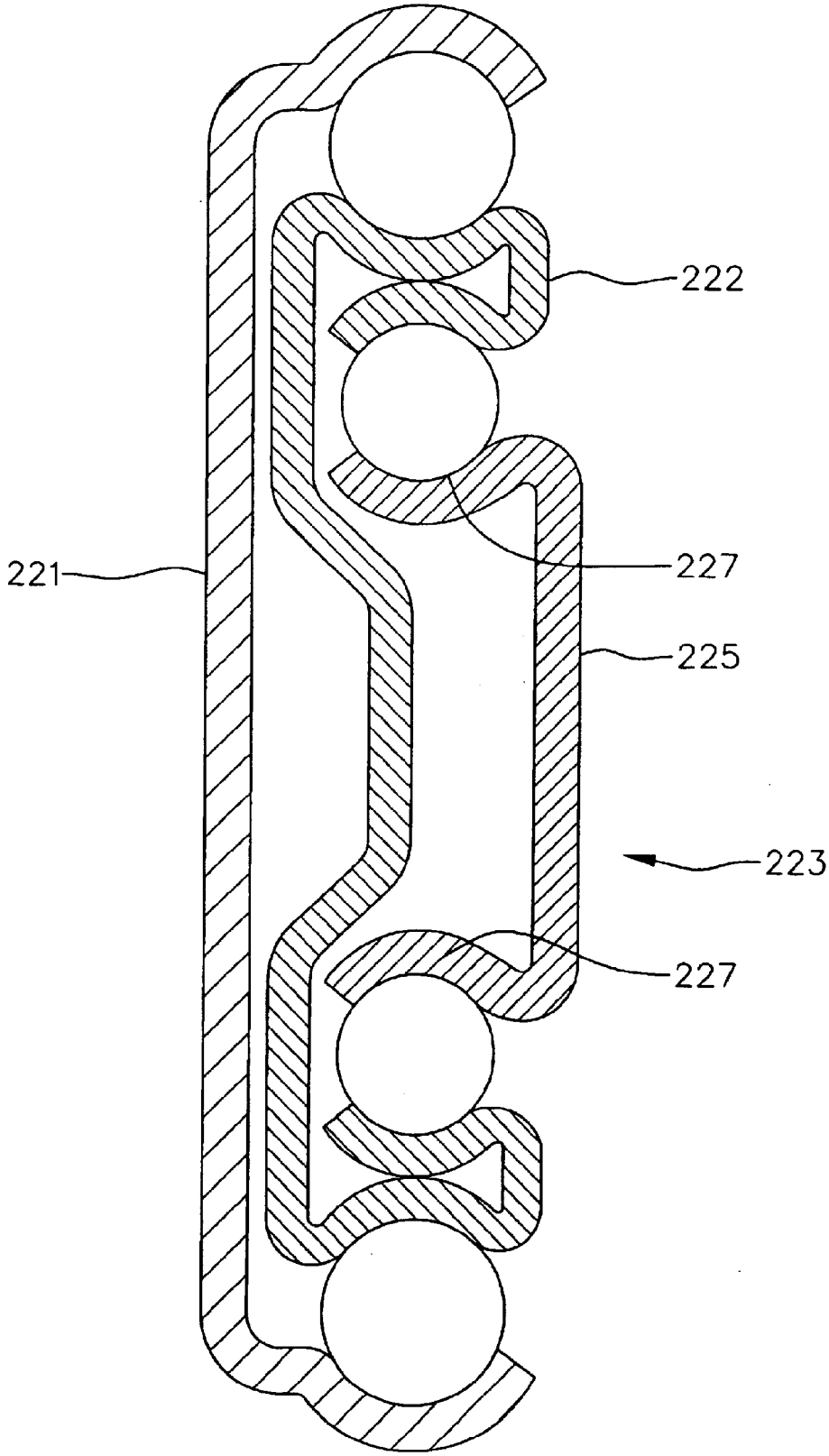
FIG. 5 illustrates a side view of a telescopic slide profile used with a position adjustment mechanism in accordance with aspects of the invention.

FIG. 5 illustrates a side view of a three rail telescopic drawer slide. The telescopic drawer slide is adapted, in some applications, to be mounted under a drawer in a cabinet. The telescopic drawer slide includes an outer member 221, and intermediate member 222, and an inner member 223. The inner member has arcuate raceways 227 on either side of a planar web 225. In some embodiments a positioning element, such as the positioning element of FIG. 2, is placed between the arcuate raceways. The web, which includes cutouts as in the slide of FIG. 1, receives the vertical positioning element and the horizontal positioning element. Adjustment of the drawer may thereafter be accomplished as previously discussed.

The invention therefore provides a positioning mechanism for a drawer slide. Although the invention has been described with respect to certain embodiments, it should be recognized that the present invention includes the claims and their equivalents supported by the disclosure.

What is claimed is:

1. A drawer slide positioning mechanism comprising:

a mounting bar adapted to be mounted to a drawer;

a tab coupled to the mounting bar, the tab including a cutout;

a first positioning element extending from the tab;

a second positioning element extending from the tab; and wherein the second positioning element includes a plate within the cutout and an offset protrusion extending from the plate.

2. The drawer slide positioning mechanism of claim 1 wherein the cutout is a countersunk hole, the plate resting in the countersunk hole.

3. The drawer slide positioning mechanism of claim 2 wherein the tab is coupled to a slot of mounting bar.

4. The drawer slide positioning mechanism of claim 3 wherein the tab includes a further cutout, the first positioning element extending through the further cutout and wherein the first positioning element is a threaded cylinder, the threaded cylinder being translatable with respect to the further cutout.

5. The drawer slide positioning mechanism of claim 4 wherein the slot and the threaded cylinder are substantially parallel.

6. A drawer slide and positioning element, comprising:

a drawer slide including a cabinet rail extensibly coupled to a shelf rail, the cabinet rail adapted to be coupled to a cabinet and the shelf rail adapted to be coupled to drawer;

a position adjustment mechanism coupled to the shelf rail, the position adjustment mechanism including a coupling bar and a tab extending from the coupling bar, the tab coupled to the shelf rail, with a threaded bolt passing through a threaded hole in the tab and a circular plate with an offset cylinder in a cutout of the tab, the threaded bolt passing through a web of the shelf rail.

7. A drawer slide and positioning element comprising:

a drawer slide including a cabinet rail extensibly coupled to a shelf rail, the cabinet rail adapted to be coupled to a cabinet and the shelf rail adapted to be coupled to drawer;

a position adjustment mechanism coupled to the shelf rail, the position adjustment mechanism including a coupling bar and a tab extending from the coupling bar, the tab coupled to the shelf rail, with a threaded bolt passing through a threaded hole in the tab and a circular plate with an offset cylinder in a cutout of the tab; and wherein the offset cylinder passes through a cutout in the shelf rail, the cutout in the shelf rail having a dimension slightly greater than the dimension of the offset cylinder.

8. A drawer slide with positioning feature, comprising:

an undermount drawer slide comprising a cabinet rail and shelf rail extendably coupled to the cabinet rail;

a positioning element within an outline of the shelf rail;

a first positioning element included with the positioning element, the first positioning element extending through a web of the shelf rail;

a second positioning element included with the positioning element, the second positioning element extending through the web of the shelf rail;

the first positioning element and the second positioning element being at least partially moveable in perpendicular directions.

9. The drawer slide with positioning feature of claim 8 wherein the first positioning element and the second positioning element extend through a cutout in the web of the shelf rail.

10. The drawer slide with positioning feature of claim 9 wherein the positioning element comprises a tab with the first positioning element and the second positioning element in cutouts of the tab.

11. The drawer slide with positioning feature of claim 10 wherein the first positioning element comprises a threaded bolt and the second positioning element comprises an offset cylinder.

12. The drawer slide with positioning feature of claim 10 wherein the positioning element is coupled to a mounting bar configured for mounting to a drawer.

13. The drawer slide with positioning feature of claim 12 wherein the positioning element further comprises claws extending from the tab, the claws engaged with the mounting bar.

14. The drawer slide with positioning feature of claim 13 further comprising a handle extending from the mounting bar.

* * * * *